United States Patent [19]

Fernandes

[11] Patent Number: 4,883,194

[45] Date of Patent: Nov. 28, 1989

[54] TEMPORARY CLOSURE FOR USE WITH STORAGE TANKS

[75] Inventor: Elson G. Fernandes, Kitchener, Canada

[73] Assignee: Clemmer Industries Limited, Waterloo, Canada

[21] Appl. No.: 284,495

[22] Filed: Dec. 15, 1988

[30] Foreign Application Priority Data

Oct. 6, 1988 [CA] Canada ..... 579529

[51] Int. Cl.[4] ..... B65D 39/00

[52] U.S. Cl. ..... 220/307; 220/296

[58] Field of Search ..... 220/306, 307, 296, 293, 220/295, 297

[56] References Cited

U.S. PATENT DOCUMENTS

| | | | |
|---|---|---|---|
| 1,727,938 | 9/1929 | Rantsch | 220/296 |
| 2,661,862 | 12/1953 | Howe | 220/296 |
| 2,711,265 | 6/1955 | Hautier | 220/296 |
| 4,245,753 | 1/1981 | Ellis | 220/296 |

FOREIGN PATENT DOCUMENTS

| | | | |
|---|---|---|---|
| 0106544 | 5/1927 | Fed. Rep. of Germany | 220/296 |
| 205540 | 1/1959 | Sweden | 220/296 |

*Primary Examiner*—Joseph Man-Fu Moy

*Attorney, Agent, or Firm*—Daryl W. Schnurr

[57] ABSTRACT

A temporary closure for containers such as storage tanks and the like has a cap portion with arcuate thread supports extending downward from a lower surface of the cap portion. The outer surface of the thread supports has screw threads thereon, the screw threads corresponding to screw threads on an inner surface of a tank opening. The closure is made of a one piece plastic material and the thread supports are flexible enough so that the closure can be quickly and easily inserted longitudinally into the tank opening with the screw threads on the closure overriding the screw threads in the tank opening. The closure is held in place in the tank opening by the screw threads and can be removed by turning or by prying the closure out of the opening with a suitable tool.

6 Claims, 3 Drawing Sheets

TEMPORARY CLOSURE FOR USE WITH STORAGE TANKS

BACKGROUND OF THE INVENTION

1. Field of the Invention

This invention relates to a temporary closure for use with an opening in containers such as storage tanks or the like. In particular, the temporary closure can be placed in a tank opening in a longitudinal direction but cannot be easily removed unless it is rotated relative to the tank opening.

2. Description of the Prior Art

Temporary closures for storage tanks are known. Unfortunately, previous temporary closures do not tightly close the tank opening; or, they can be pulled entirely into the tank or forced outwardly from the opening by pressure changes within the tank; or, they are cumbersome to install or remove; or, they do not permit the passage of air into or out of the tank; or, they do not prevent the entry of free-falling water into the tank; or, they are too complex or too expensive to manufacture.

SUMMARY OF THE INVENTION

It is an object of the present invention to provide a temporary closure for containers such as storage tanks or the like that can be quickly inserted into a tank opening, but once inserted will not be removed through pressure changes within the tank.

A temporary closure can be used with an opening in storage tanks or the like, said opening having screw threads located on an inner surface. The closure has a cap portion and is made of a slightly flexible but rigid material, said cap portion having an upper and lower surface when said closure is in an upright position. A plurality of spaced-apart arcuate thread supports extend away from said lower surface, said supports having screw threads on an outer surface thereof. The screw threads together corresponding to screw threads in the tank opening. The thread supports are arranged to form an intermittent circle of a size that will fit snugly within the tank opening with the screw threads of the tank engaged with the screw threads of the closure. The upper surface of the cap portion contains means to rotate the closure. The thread supports are flexible enough so that the closure can be pushed into the tank opening in a longitudinal direction until the lower surface of the cap portion abuts the outer surface of the tank opening and the screw threads of the enclosure are engaged with the screw threads of the tank. The closure is removable from the tank opening by rotating the closure in an appropriate direction.

BRIEF DESCRIPTION OF THE DRAWINGS

In drawings which illustrate a preferred embodiment of the invention.

DESCRIPTION OF A PREFERRED EMBODIMENT

Figure 1:
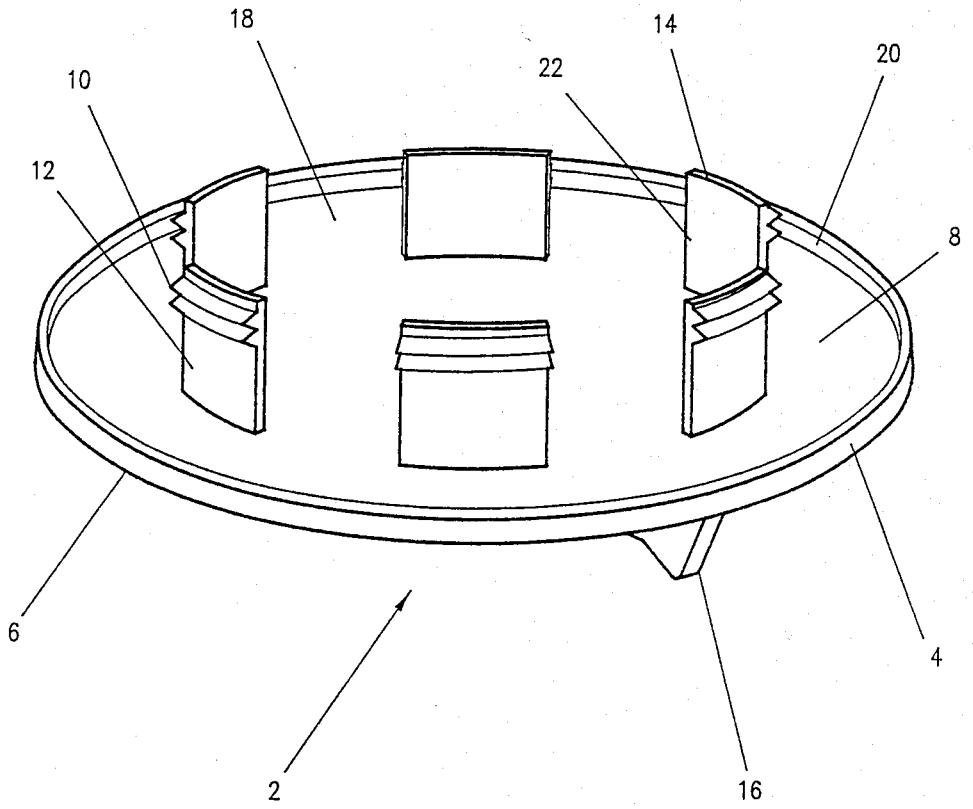
FIG. 1 is a perspective view of a lower surface of a closure with the closure turned up-sidedown.
Figure 2:
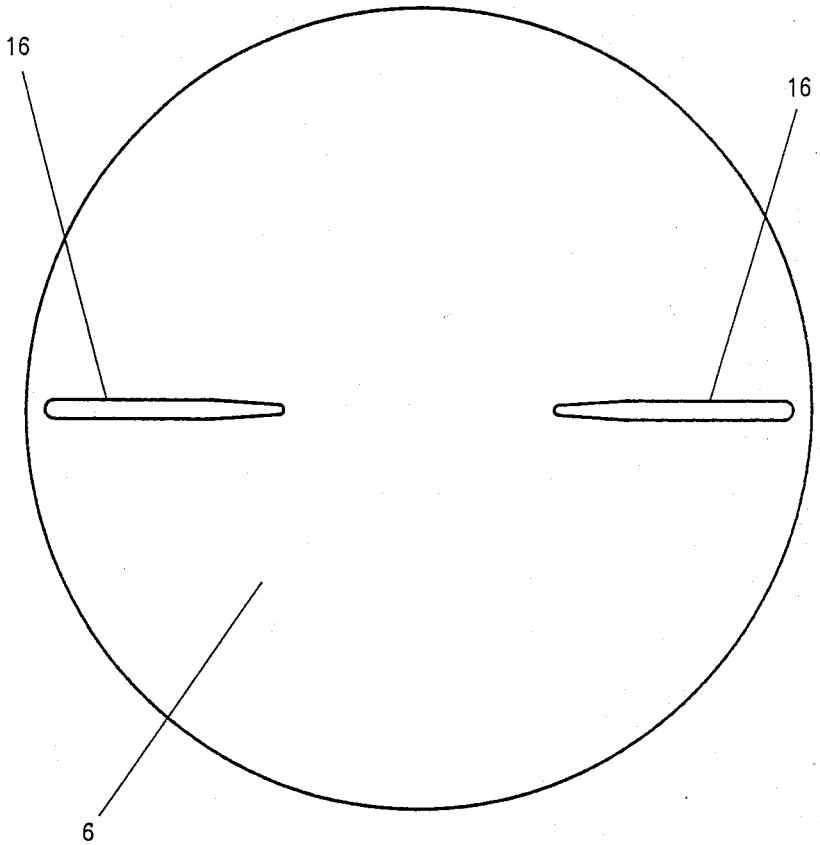
FIG. 2 is a top view of the closure.

Referring to the drawings in greater detail, in FIGS. 1 and 2, the closure 2 has a cap portion 4 with an upper surface 6 and a lower surface 8 when the closure is in an upright position. The lower surface has interlocking means which are shown as screw threads 10 located on an outer surface 12 of thread supports 14. There are a plurality of spaced-apart arcuate supports 14 extending away from the lower surface 8. The supports 14 are arranged to form an intermittent circle of a size that will fit snugly within a tank opening (not shown in FIGS. 1 and 2). The upper surface 6 of the cap portion 4 contains means 16 to rotate the closure 2 relative to the tank. The means 16 is simply two ridges located 180° apart from one another that together form a handle to allow the closure to be turned manually.

Preferably, the closure is made of a one piece plastic material. There are various plastic resins, for example, polyethylene, that will be suitable.

Between each of the thread supports 14, there is a space 18, there being six thread supports and six spaces, the thread supports being approximately the same size as the spaces. The cap portion 4 has a circular shape and the lower surface is generally flat with a flange 20 extending downward from a periphery thereof. The flange 20 assists in deflecting water away from the tank opening (not shown in FIGS. 1 and 2).

The outer surface 12 of the thread supports 14 are substantially perpendicular to the lower surface 8 of the cap portion 4. An inner surface 22 of the thread supports 14 is situated at an angle of substantially 2° relative to the outer surface 12, the inner surface 22 tapering linearly from said outer surface 12 towards the lower surface 8 of the cap portion 4.

Figure 3:
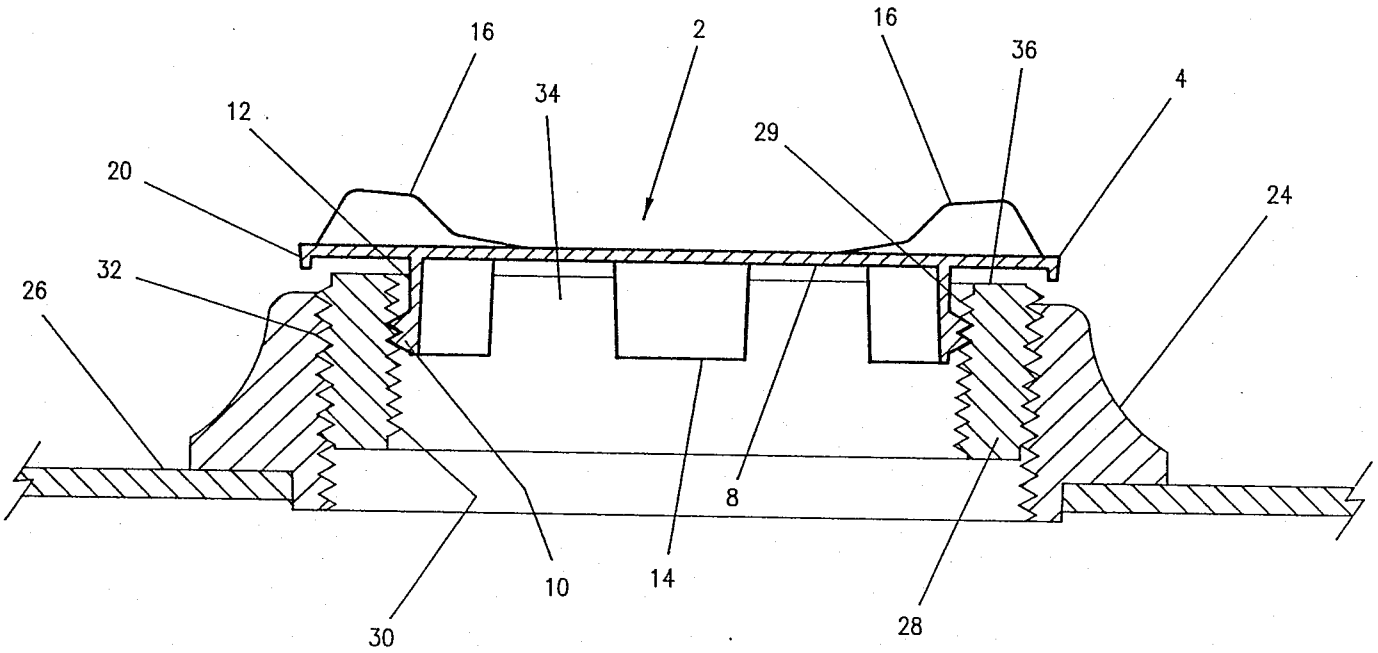
FIG. 3 is a sectional side view of the closure inserted into a bushing in a container.

In FIG. 3, there is shown a tank fitting 24 mounted in a tank 26. The tank fitting 24 has a threaded inner surface and is circular in shape. A bushing 28 having threaded inner and outer surfaces 30, 32 respectively is threaded into the fitting 24. Preferably, the bushing 28 is made of nylon. The closure 2 is sized to fit within a tank opening 34 as reduced in size by the fitting 24 in bushing 28. The closure 2 has thread supports 14 containing interlocking means, which are shown as screw threads 10 on an outer surface 12 thereof. The screw threads 10 of the closure 2 engage screw threads 29 on the inner surface 30 of the bushing 28. The screw threads 29 can also be referred to as interlocking means.

The closure 2 can be pushed into the opening 34 in a longitudinal direction. The thread supports 14 are flexible enough to bend slightly so that the screw threads 10 will override the screw threads 29 until the lower surface 8 of the cap portion 4 abuts a top surface 36 of the bushing 28. This can be referred to as an installed position and is shown in FIG. 3. Once the closure 2 is in the installed position, it is held in place by the engagement of the screw threads 10 on the closure with the corresponding screw threads 29 on the bushing. In this installed position, air can enter and leave the tank 26 through the air passages or spaces 18 between the thread supports 14. However, the opening 34 is sufficiently closed to prevent free-falling water, for example, rain from entering the tank 26 through the opening 34.

When it is desired to remove the closure 2 from the opening 34, the closure can be manually turned by applying a rotational force to the ridges 16, thereby turning the closure in an appropriate direction relative to the tank 26. Usually, the appropriate direction would be counterclockwise and the screw threads 10, 29 would move relative to one another until they became completely disengaged and the closure 2 could then be completely removed from the opening 34. Of course, the closure 2 can also be removed from the opening 34 by prying or pulling with a force greater than the holding force of the screw thread 10. For example a suitable tool such as a vice grips could be affixed to the handle 16 and the closure can be forced longitudinally out of the opening the screw threads on the closure overriding the screw threads on the tank opening.

The closure can be designed to fit within virtually any size of tank opening. Numerous variations, within the scope of the attached claims, will be readily apparent to those skilled in the art.

What I claim as my invention is:

1. A temporary closure for use with an opening in storage tanks or the like, said opening having screw threads located on an inner surface, said closure comprising a cap portion and being made of a slightly flexible but rigid material, said cap portion having an upper and lower surface when said closure is in an upright position, a plurality of spaced apart arcuate threads supports extending away from said lower surface, said supports having screw threads on an outer surface thereof, said screw threads together corresponding to screw threads in the tank opening, said thread supports being arranged to form an intermittent circle of a size that will fit snugly within the tank opening with the screw threads of the tank engaged with the screw threads of the closure, the upper surface of the cap portion containing means to rotate the closure, the thread supports being flexible enough so that the closure can be pushed into the tank opening in a longitudinal direction until the lower surface of the cap portion abuts the outer surface of the tank opening and the screw threads of the closure are engaged with the screw threads of the tank, the closure being removable from the tank opening by rotating the closure in an appropriate direction.

2. A closure as claimed in claim 1 wherein the closure is made of a one-piece plastic material.

3. A closure as claimed in claim 1 wherein the thread supports are approximately equal in size to the spaces between the thread supports.

4. A closure as claimed in claim 1 wherein the cap portion has a circular shape and the lower surface is generally flat with a flange extending downward from a periphery of the cap portion, the flange assisting in deflecting water away from the tank opening.

5. A closure as claimed in claim 2 wherein the thread supports have an outer surface that is substantially perpendicular to the lower surface of the cap portion and an inner surface that is at an angle of substantially 2° relative to the outer surface, the inner surface tapering linearly away from said outer surface towards the lower surface of said cap portion.

6. A closure as claimed in claim 1 wherein the means to rotate the closure are two ridges, located 180° apart from one another on an upper surface of the cap portion, said ridges together forming a handle so that the closure can be removed manually.

* * * * *